US010961648B2

(12) United States Patent
Stein et al.

(10) Patent No.: US 10,961,648 B2
(45) Date of Patent: Mar. 30, 2021

(54) DYE APPLICATOR FOR DYEING ARTICLES, A DYE APPLICATION KIT, AND A METHOD FOR MANUFACTURING THE SAME

(71) Applicant: SPIN MASTER LTD., Toronto (CA)

(72) Inventors: Tali Stein, Rishon LeZion (IL); Inna Yankelovich Shimelmits, Tel Aviv (IL); Gilad Podgor, Givatayim (IL); Roy Kfir, Tel Aviv (IL); Yair Yarkoni, Reut-Maccabim-Modiin (IL); Vered Bahat, Tel Aviv (IL); Kyra Crilly, Toronto (CA)

(73) Assignee: SPIN MASTER LTD., Toronto (CA)

( * ) Notice: Subject to any disclaimer, the term of this patent is extended or adjusted under 35 U.S.C. 154(b) by 451 days.

(21) Appl. No.: 15/726,729

(22) Filed: Oct. 6, 2017

(65) Prior Publication Data

US 2019/0106824 A1 Apr. 11, 2019

(51) Int. Cl.

| | |
|---|---|
| ***D06B 11/00*** | (2006.01) |
| ***D06B 23/14*** | (2006.01) |
| ***D06P 5/12*** | (2006.01) |

(52) U.S. Cl.

CPC ..... *D06B 11/0056* (2013.01); *D06B 11/0073* (2013.01); *D06B 11/0089* (2013.01); *D06B 23/14* (2013.01); *D06P 5/12* (2013.01)

(58) Field of Classification Search

CPC ..... D06B 11/0056; D06B 11/0073; D06B 11/0089; D06B 23/14; D06P 5/12

USPC ..... 8/482; 68/213, 214; 206/568, 575

See application file for complete search history.

(56) References Cited

U.S. PATENT DOCUMENTS

| | | | |
|---|---|---|---|
| 4,951,483 | A | 8/1990 | van Olphen |
| 5,640,859 | A | 6/1997 | Fromm |
| 2013/0055509 | A1 | 3/2013 | Wijerama |

FOREIGN PATENT DOCUMENTS

| | | | |
|---|---|---|---|
| CN | 101718045 | B | 7/2012 |

OTHER PUBLICATIONS

Provax, Alyson, "Shibori Dyeing", Seamwork Magazine, Collette Media, LLC, published Aug. 2015, www.seamwork.com/issues/2015/08/shibori-dyeing.

*Primary Examiner* — Levon J Shahinian

(74) *Attorney, Agent, or Firm* — Millman IP Inc.

(57) ABSTRACT

A dye applicator for dyeing materials, a dye application kit, and a method for manufacturing the same are provided. The dye application kit has at least one container containing a dye applicator being at least partially fibrous and infused with a dry water-soluble dye, the dye being transferrable to an adjacent article in the presence of water.

16 Claims, 12 Drawing Sheets

DYE APPLICATOR FOR DYEING ARTICLES, A DYE APPLICATION KIT, AND A METHOD FOR MANUFACTURING THE SAME

FIELD

The specification relates generally to crafts. In particular, the following relates to a dye applicator for dyeing articles, a dye application kit, and a method for manufacturing the same.

BACKGROUND OF THE DISCLOSURE

Custom material dyeing is known. A dye is applied to a material in a non-homogeneous manner. Various methods have been used to produce patterns of dyeing on materials, such as apparel fabric. In one example, regions of an article are compressed between blocks to restrict the saturation of dye in the regions. In another approach referred to commonly as "tie-dyeing", portions of the material are twisted, pleated, crumpled, etc. and bound with string or rubber bands, and dye is applied to the article. The ties restrict saturation of the dye in the compressed regions of the article.

Dyes applied to the fabric articles are typically water-soluble and applied in a bath by thoroughly immersing the articles therein. When the articles are withdrawn, excess water and dye is typically allowed to drip from the article into the bath, and then the article is let dry to allow the dye to set.

The application of dye using such techniques can, however, be messy as the article is soaked in the dye-saturated water and splashing can occur when the article is withdrawn from the bath. It can be strongly desirable to wear long latex gloves or the like while handling the article to place it in the bath, move it about therein to ensure that the dye is adequately saturated within the exposed regions of the article, and withdraw it from the bath to reduce the chance of staining of a user's skin. Further, it can be difficult to ensure the exposed regions of the article are saturated with dye without the use of more dye than required, leading to wasted dye.

SUMMARY OF THE DISCLOSURE

In one aspect, there is provided a dye application kit, comprising at least one container containing a dye applicator being at least partially fibrous and infused with a dry water-soluble dye, the dye being transferrable to an adjacent article in the presence of water.

The dye applicator contained in one of the at least one container can have a single dye applied thereto. Alternatively, the dye applicator contained in one of the at least one container can have at least two dyes applied thereto.

The dye applicator can be a string.

The dye application kit can include a drum around which an article can be secured and over which the string can be wrapped. The drum can be generally cylindrical. The dye application kit can include a base having at least two drum supports that support the drum proximal two opposite longitudinal ends thereof and enable the drum to rotate when supported thereon. The drum can have a first axle end extending from one of the two opposite ends of the drum and a second axle end extending from another of the two opposite ends of the drum, the drum supports receiving the first axle end and the second axle end to support the drum. The base can have a basin disposed below the drum when the base is positioned on a table surface and the drum is resting on the drum supports.

At least one flexible band that can secure the article to the drum can be included in the dye application kit, the at least one flexible band having at least one feature to which the string can be secured. Each of the flexible bands can include at least one sizing peg and at least one sizing aperture for securing the flexible band to the drum about the article.

The dye applicator can have an adhesive surface having an adhesive that adheres to the adjacent article sufficiently when exposed thereto to inhibit saturation of the dye in the article adhered to the dye applicator, the adhesive being sufficiently weak to permit manual removal of the dye applicator from the article.

The dye applicator can comprise a fabric hair elastic that is infused with the dry water-soluble dye.

The dye application kit can include instructions to place the dye applicator adjacent an article to be dyed and to wet the dye applicator with water.

In another aspect, there is provided a dye applicator for dyeing materials, the dye applicator being infused with a dry water-soluble dye, the dye being transferrable to an adjacent article when water is applied.

The dye applicator can be, amongst other things, a string or a fabric hair elastic.

Alternatively, the dye applicator can have an adhesive surface having an adhesive that adheres to the adjacent material sufficiently when exposed thereto to inhibit saturation of the dye in the material adhered to the dye applicator, the adhesive being sufficiently weak to permit manual removal of the dye applicator from the material.

Still alternatively, the dye applicator can be a roller having a fibrous cover.

The dye applicator can be a paper product.

The dye applicator can be a pipe cleaner.

In a further aspect, there is provided a method of manufacturing a dye application kit, comprising exposing a dye applicator to an aqueous dye solution until the dye applicator is at least partially saturated with the aqueous dye solution, drying the dye applicator, and packaging the dye applicator with instructions to place the dye applicator adjacent an article to be dyed and to wet the dye applicator with water.

The instructions can direct a user to apply water to the material to be dyed prior to placement of the dye applicator.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1:
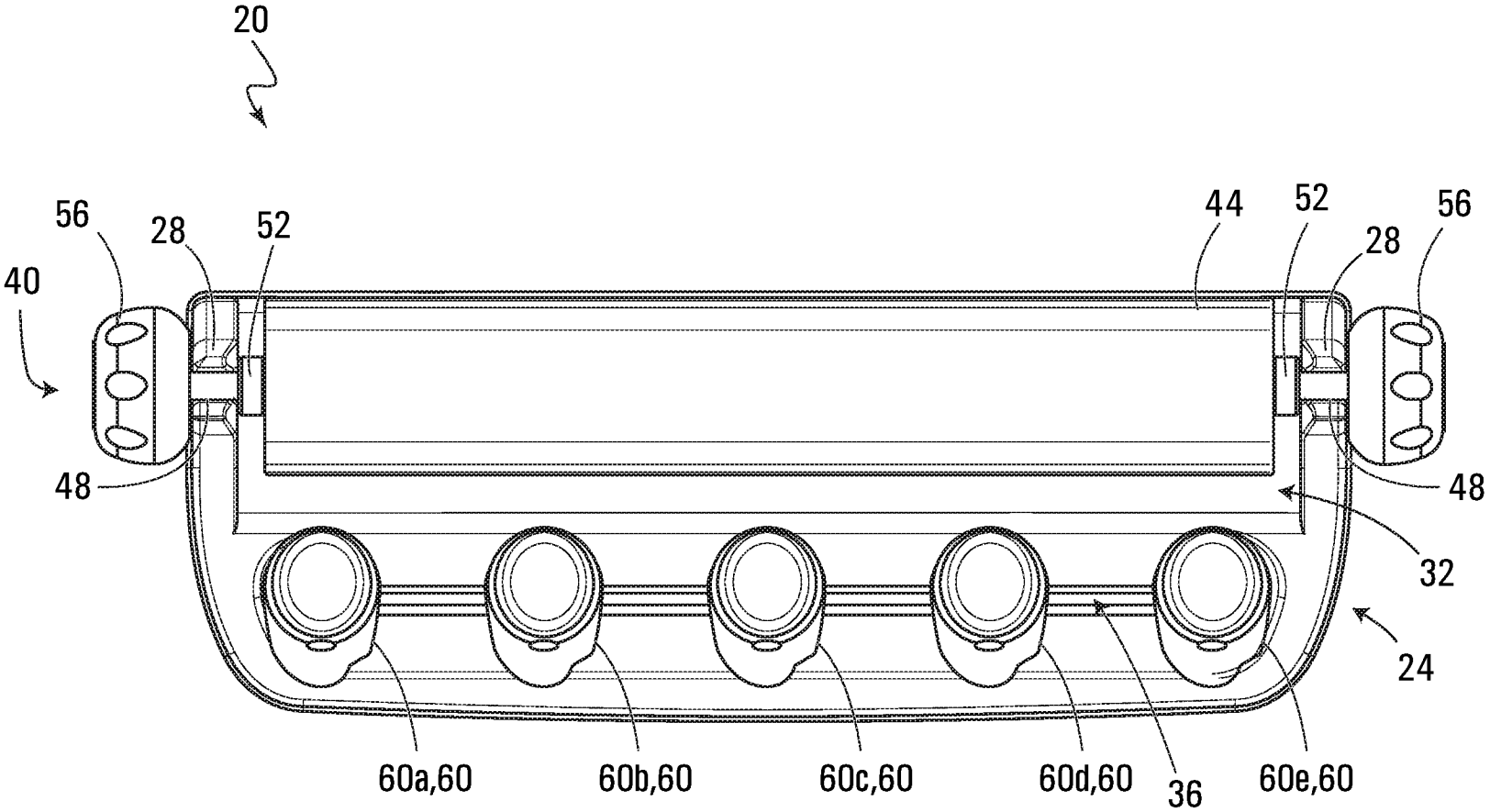
FIG. 1 shows a plan view of a dye application tool in accordance with one embodiment.

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Figure 2:
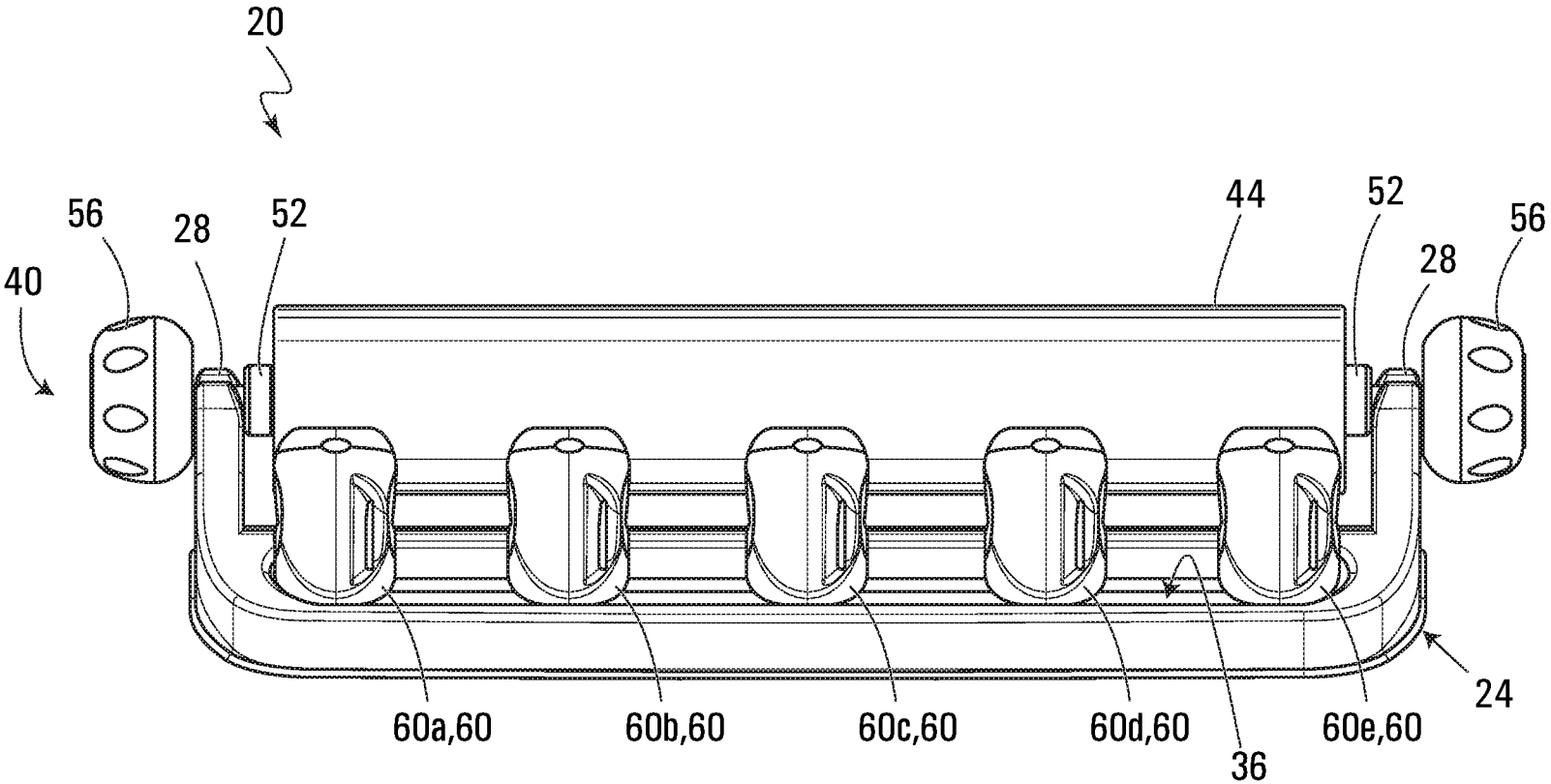
FIG. 2 is a front view of the dye application tool of FIG. 1.

FIGS. 1 and 2 show a dye application tool 20 in accordance with one embodiment. The dye application tool 20 is sold disassembled as part of a kit. The dye application tool 20 has a base 24 with a generally flat undersurface with a rubber pad or footing, enabling the dye application tool 20 to be placed stably atop of a table surface or another flat surface. The base 24 has two drum supports 28 extending upward. Each of the drum supports 28 has an axle slot. A basin 32 extends between the drum supports 28. A dispenser positioning slot 36 extends parallelly to the basin 32.

A drum unit 40 is supported by the drum supports 28 so that it is suspended above the basin 32. The drum unit 40 has a drum 44 that is cylindrical in shape. The drum 44 has a rubber surface providing grip. A pair of axle ends 48 extend from longitudinal ends of the drum 44, and are cradled within drum unit slots atop of the drum supports 28 to suspend the drum unit 40. The axle ends 48 are cylindrical and rotate freely within a generally cylindrical recess of the drum unit slots. A spacer 52 is located on each axle end 48 proximate the drum 44. The spacers 52 maintain a separation between the drum 44 and the drum supports 28 when the drum unit 40 is resting thereon. A rotation knob 56 caps each axle end 48 and facilitates rotation of the drum unit 40 when supported by the drum supports 28.

A set of five dye-infused string dispensers 60 are secured within the dispenser positioning slot 36 of the base 24. Each of the dye-infused string dispensers 60 dispenses a string that is infused with a different color. A first dye-infused string dispenser 60*a* dispenses blue dye-infused string, a second dye-infused string dispenser 60*b* dispenses purple dye-infused string, a third dye-infused string dispenser 60*c* dispenses green dye-infused string, a fourth dye-infused string dispenser 60*d* dispenses orange dye-infused string, and a fifth dye-infused string dispenser 60*e* dispenses pink dye-infused string.

Figure 4:
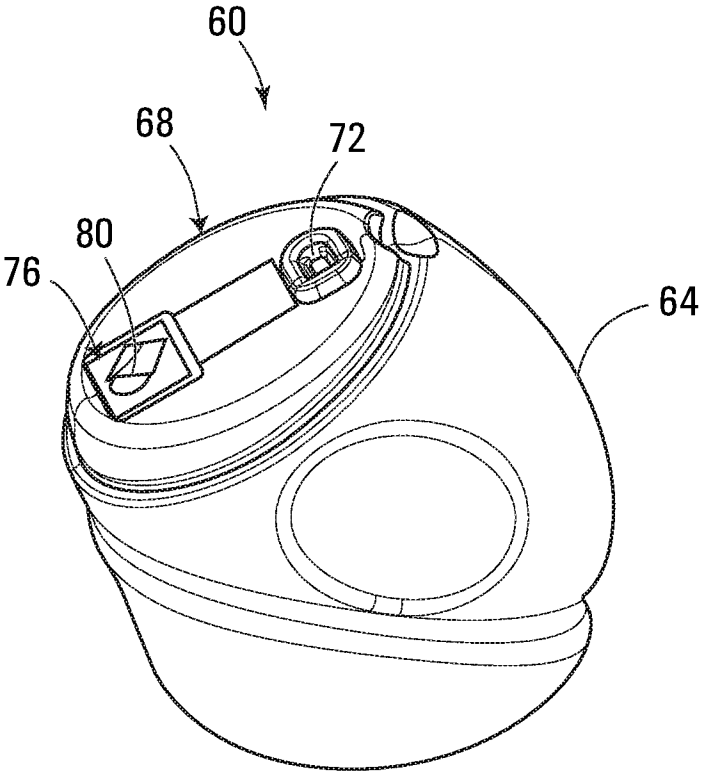
FIG. 4 is a top side rear perspective view of the dye-infused string dispenser of FIG. 3.
Figure 3:
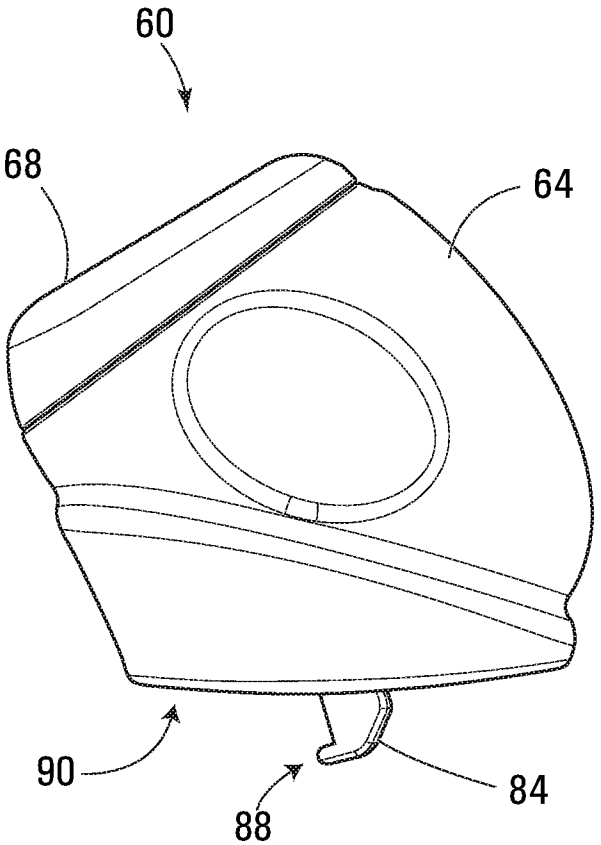
FIG. 3 is a side elevation view of a dye-infused string dispenser of the dye application tool of FIG. 1.
Figure 5:
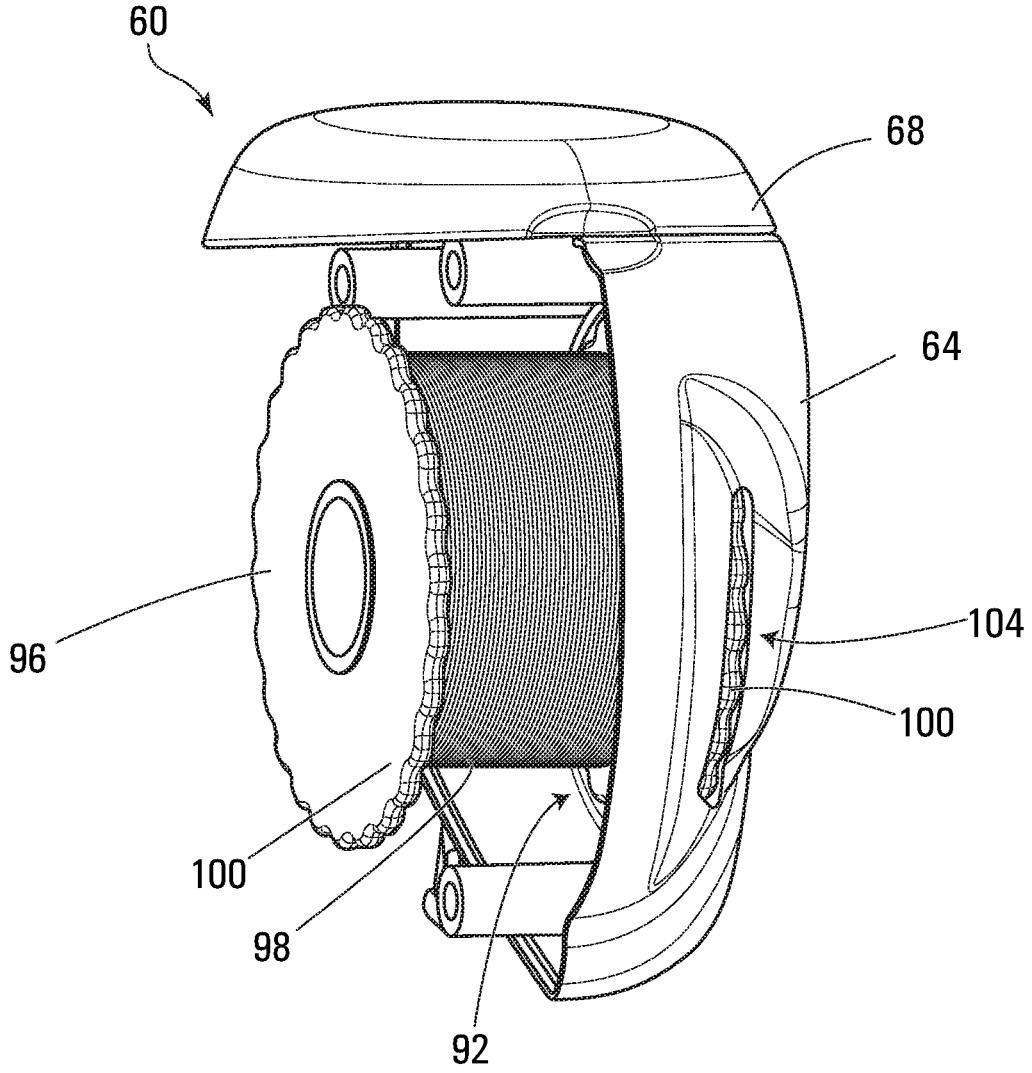
FIG. 5 is a top side front perspective view of the dye-infused string dispenser of FIG. 3 with a portion of the housing removed.

FIGS. 3 to 5 illustrate one of the dye-infused string dispensers 60 in greater detail. The dye-infused string dispenser 60 has a housing 64 made of a suitable material such as a plastic or a resin. A dispenser cap 68 crowns the housing 64, and has a string port 72. A metal insert 76 is affixed to the dispenser cap 68 and has a stamped cutting tab 80 that is inclined upwardly. The dispenser housing 64 has a securement anchor 84 with a spur 88 extending downwardly from its bottom surface 90.

The housing 64 has an internal chamber 92 that houses a spool 96 around which is wound dye-infused string 98. The spool 96 has two flanges 100 that have undulating edges. When the spool 96 is positioned in the housing 64, the undulating edges of one of the flanges 100 extend through a control slot 104 in the side of the housing 64, enabling the spool 96 to be rotated to dispense more string 98 or withdraw some dye-infused string 98 that has been dispensed.

The dye-infused string 98 is a dye applicator that is fibrous and impregnated with a dry water-soluble dye. The string can be twine, cord, yarn, thread, strand, rope, a filament, etc. The dye used can be any color, tint, pigment, stain, wash, colorant, coloring, dyestuff, or other substance that is suitable for application to the material when borne in a carrier fluid to change its appearance and is set to the material once the carrier liquid is removed, such as via drying. The type of suitable dye can vary depending on the type of article being dyed. In some scenarios, the articles are made of fabric, but in others can be made of other fibrous materials, such as paper, wood, or felt, or non-fibrous materials, such as foam, plastic, etc. Carrier fluids can include water, water with additives such as sodium chloride, sodium sulfate, or sodium carbonate, etc. The water-soluble dye is dry in that it is generally absent of any water beyond the humidity in the ambient air.

Figure 6:
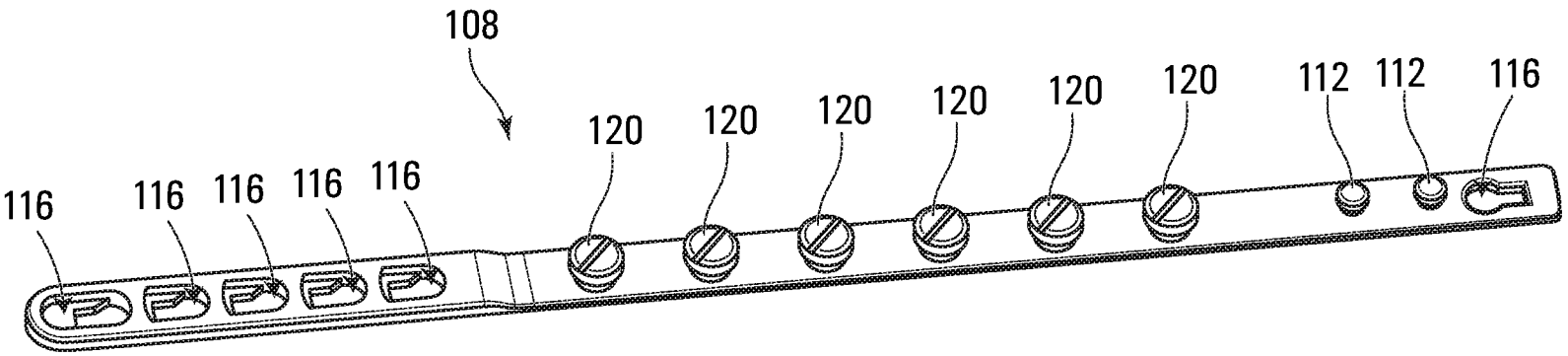
FIG. 6 is one of a set of rubber bands stored in a recess of the basin of the base of the dye application tool of FIG. 1 that is used to secure fabric articles to the drum thereof.

FIG. 6 shows one of a set of rubber bands 108 forming part of the kit. The rubber band 108 stored in a recess of the basin of the base 24 of the dye application tool 20 when not in use. The rubber bands 108 are used to secure a material article to be dyed to the drum 44. The rubber bands 108 have a set of sizing pegs 112 proximate a first end thereof and a corresponding set of sizing apertures 116 proximate a second end thereof. The sizing pegs 112 are designed to be received securely within the sizing apertures 116 and lock therein under tension. The rubber bands 108 also have a set of securement posts 120. Each securement post 120 has a slot on its top surface.

Figure 7:
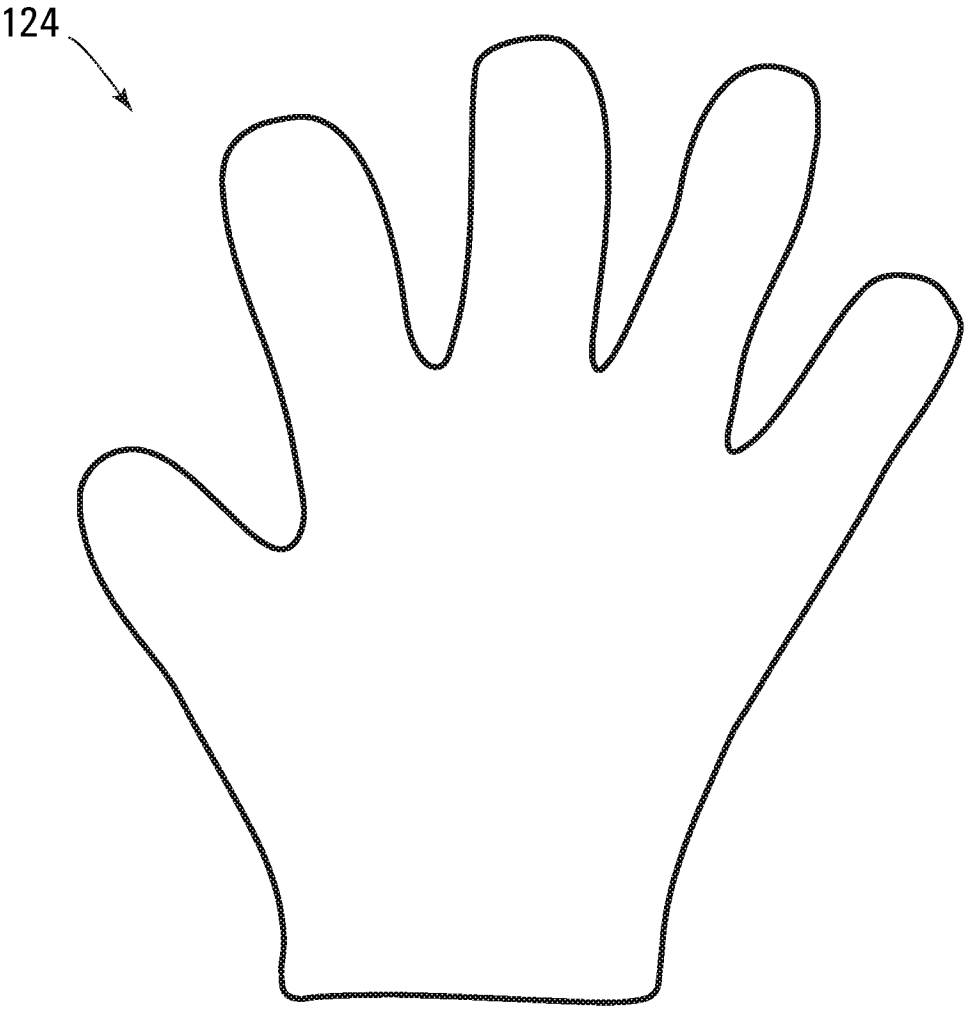
FIG. 7 is a one of the plastic gloves that is provided with the dye application tool of FIG. 1.

FIG. 7 shows one of the plastic gloves that is provided with the kit for the dye application tool 20. The dry water-soluble dye on the string 98 may react with the oils and/or moisture on the barer hands of a user. As a result, plastic gloves are provided to protect the user's hands from contacting the string and/or dyes.

In order to dye an article 128 such as an item of clothing made of fabric, the article 128 is soaked or otherwise dampened with water. The wet article 128 is then wrapped around the drum 44 of the drum unit 40, and then secured therearound using the rubber bands 108 provided with the kit. The rubber bands 108 are secured around the article 128, with the sizing pegs 112 and the securement posts 120 facing radially outward, by slipping the sizing apertures 116 over the sizing pegs 112. Preferably, the rubber bands 108 border an area to which dyeing is to be applied and generally hold the article 128 close to the drum unit 40. Alternatively, the article 128 can be soaked or dampened with water after it is secured to the drum 44 in some cases.

Figure 8:
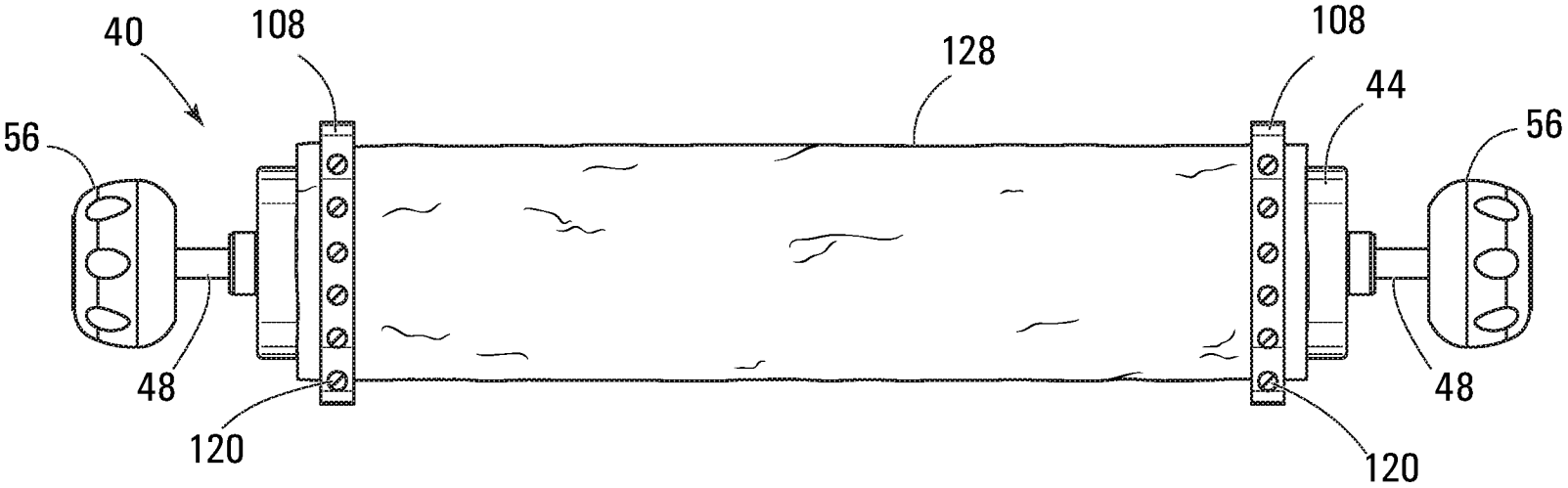
FIG. 8 shows the drum of the dye application tool of FIG. 1 after a wet fabric article has been secured thereto using two of the rubber bands of FIG. 6.

FIG. 8 shows the drum of the dye application tool of FIG. 1 after a wet fabric article has been secured thereto using two of the rubber bands of FIG. 6.

Figure 9:
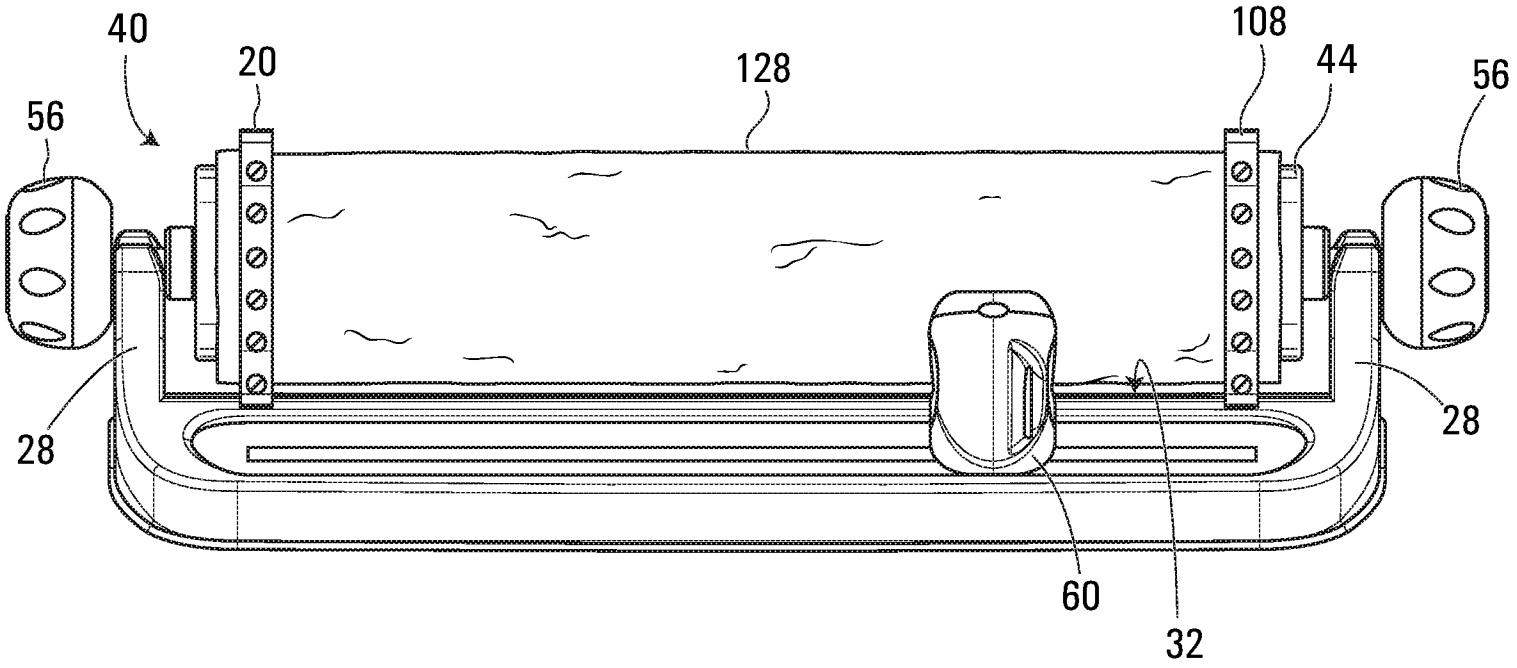
FIG. 9 shows the drum with the wet fabric article secured thereto being placed back on the drum supports of the base of the dye application tool of FIG. 1.

Upon securing the wet article 128 to the drum unit 40, the drum unit 40 is cradled atop of the drum supports 28 of the base 24, as is shown in FIG. 9. Excess water from the wet article 128 can drip into the basin 32.

A dye-infused string 98 of a desired color is selected, and the other dye-infused string dispensers 60 are removed from the dispenser positioning slot 36. The dye-infused string from the selected dye-infused strong dispenser 60 that remains anchored in the dispenser positioning slot 36 and secured to one of the securement posts 120 of one of the rubber bands 108 by wrapping it therearound a number of turns. Once the dye-infused string 98 is secured to the rubber band 108, the dye-infused string 98 can be wrapped around the article 128 by turning the rotation knobs 56 so that the dye-infused string 98 is pulled out of the dye-infused string dispenser 60 and wrapped around the article 128 on the drum 44. As the drum 44 is turned, the dye-infused string dispenser 60 can be slid along the dispenser positioning slot 36 to control how the dye-infused string 98 is wound around the article 128. Tension on the dye-infused string 98 as it is pulled around the article 128 on the drum 44 pulls the upper end of the dye-infused string dispenser 60 towards the drum 44, but the dye-infused string dispenser 60 is held in the dispenser positioning slot 36 by the securement anchor 84 on its bottom surface. Alternatively, the dye-infused string 98 can be tied between the rubber bands 108 generally coaxial to the rotation axis of the drum unit 40.

Figure 10:
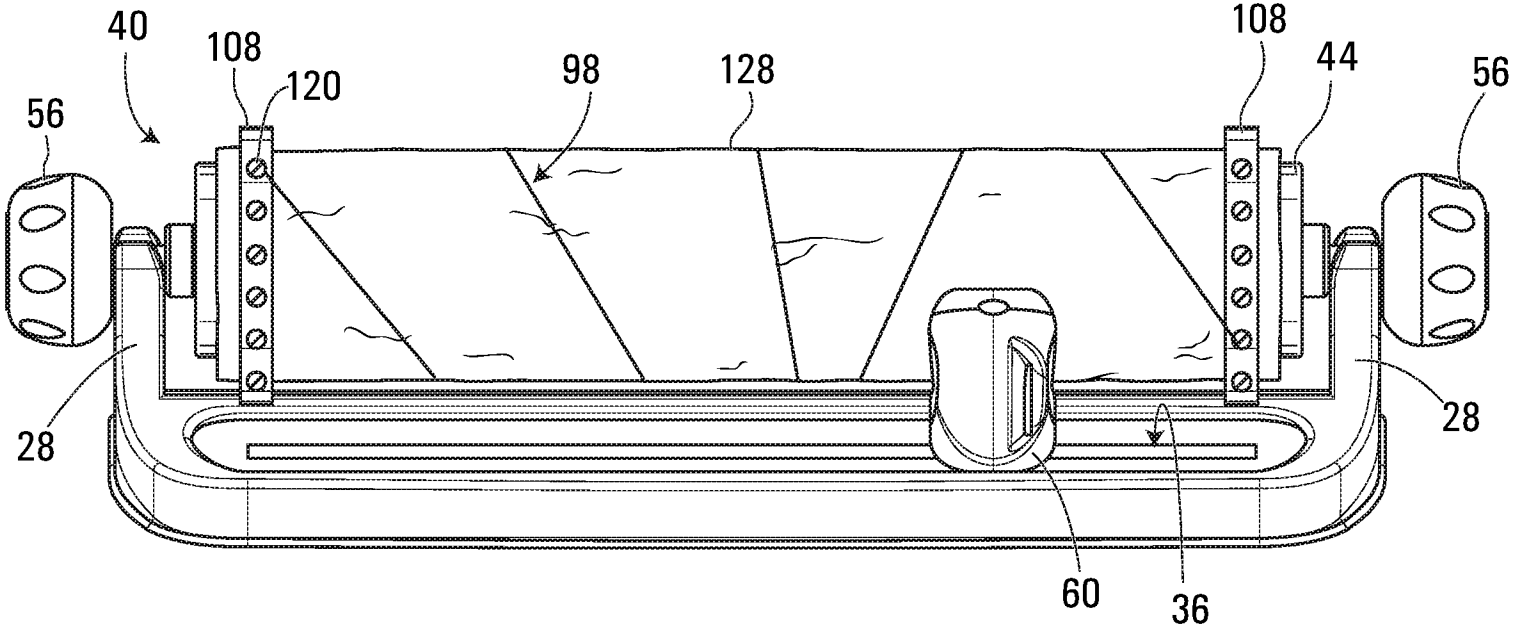
FIG. 10 shows dye-infused string wrapped around the wet fabric item on the drum of the dye application tool of FIG. 1.

FIG. 10 shows the article 128 secured around the drum 44 after application of the dye-infused string 98 therearound.

The dye-infused string 98 can then be cut via the stamped cutting tab 80 and its loose end can be secured to the securement post 120 of one of the rubber bands 108 holding the article 128 on the drum 44.

When held against the wet article 128, the dye-infused string 98 absorbs water and the dry dye in the dye-infused string 98 mixes with the water to form a water-borne dye. This water-borne dye leeches onto the article 128 and spreads about the contact locations of the dye-infused string 98 with the article 128.

Figure 11:
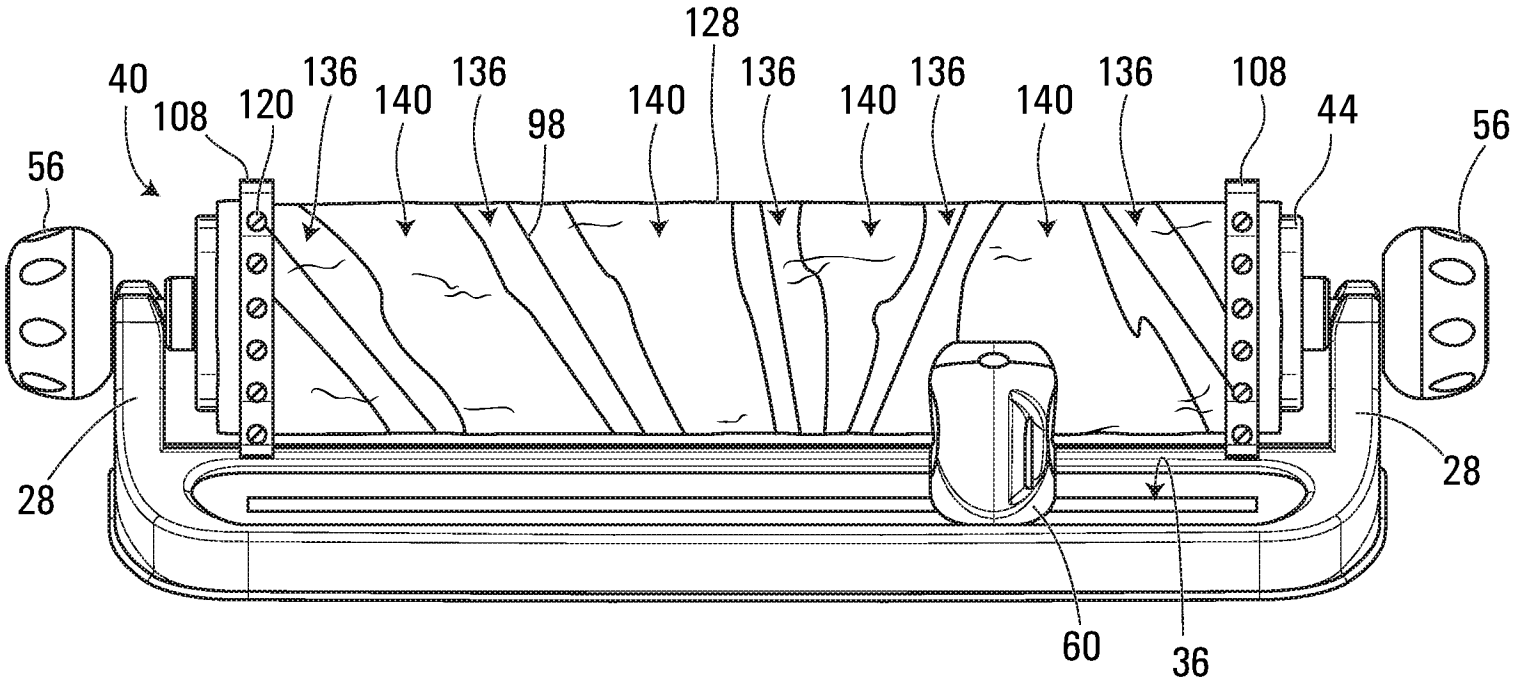
FIG. 11 shows the dye from the dye-infused string bleeding onto the fabric item shown in FIG. 10.

FIG. 11 shows a pattern of dyeing of the article 128 after the dye from the dye-infused string 98 has bled to adjacent dyed areas 136 of the article 128. The dyed areas 136 of the article 128 can be separated by undyed areas 140 of the article 128 that are further away from the dye-infused string 98.

Once the dye has been applied as desired to the article 128, the dye-infused string 98 is removed from the drum unit 40 by untying or cutting it, and the article 128 is released from the drum 44 by removing the rubber bands 108. The article 128 is then unwrapped from the drum 44 and hung or placed somewhere to dry.

In some cases, it can be desirable to use two or more dye-infused strings 98 at one time by either wrapping them one after the other around the wet article 128, or by simultaneously wrapping them around the article with both dye-infused string dispensers 60 positioned in the dispenser positioning slot 36. Further, the dye-infused strings 98 may simply extend directly between securement posts 120 on the rubber bands 108 and not wrap around the article 128. Still further, the loose end of a dye-infused string 98 can be secured under another dye-infused string 98 or under itself.

Rubber bands 108 can also be deployed intermediate the ends of the article 128 adjacent the longitudinal ends of the drum 44. Further, rubber bands 108 can be secured to other rubber bands 108 so that they extend longitudinally along the rotation axis of the drum unit 40.

While, in the above embodiment, the dye applicator is a dye-infused string, other types of dye applicators can be manufactured. In some embodiments, the dye applicators can be at least partially fibrous. For example, the dye applicators can be at least partially fabric, felt, pipe cleaners, and other fiber structures, such as carpet pile, brushes, etc. The fibrous portion can be of a natural material, such as vegetable fibers such as cotton and linen, wood fiber, biological fiber such as hair, and mineral fiber. Alternatively, the fibrous portion can be of a man-made fiber, such as nylon, metal, fiberglass, silicon carbide, rayon, polyester, etc. Still further, a combination of man-made and natural fibers can be employed.

Figure 12:
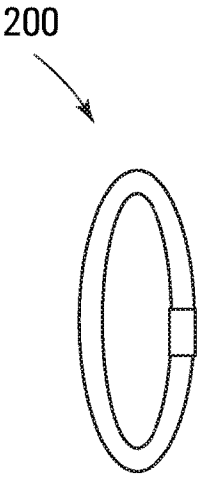
FIG. 12 shows a dye-infused fabric hair elastic in accordance with another embodiment.

FIG. 12 shows a dye applicator in accordance with another embodiment. In this embodiment, the dye applicator is a dye-infused fabric hair elastic 200. The dye-infused fabric hair elastic 200 is made of an elastic fabric or is an elastic having a fabric covering. The fabric is infused with dry dye that can be transferred to adjacent materials, such as the hair of a user, upon the application of water.

Figure 13:
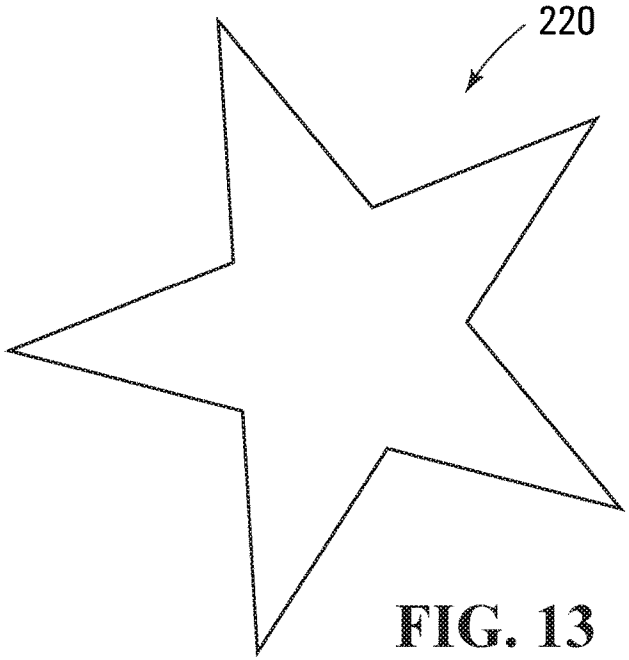
FIG. 13 is a plan view of a dye-infused sticker in accordance with a further embodiment.
Figure 14:
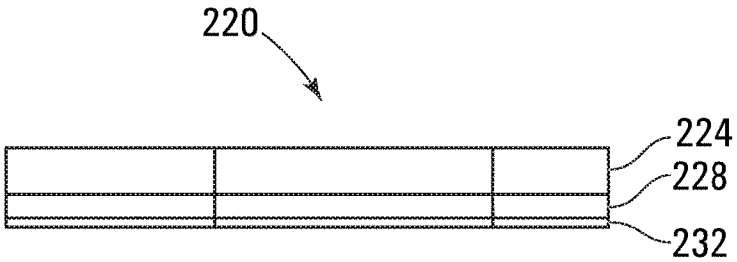
FIG. 14 is a side view of the dye-infused sticker of FIG. 13.

FIGS. 13 and 14 show a dye applicator in accordance with another embodiment. In this embodiment, the dye applicator is a dye-infused sticker 220 that includes a felt pad 224 secured to an adhesive layer 228. The felt pad 224 can be infused with dye and dried prior to it being coupled with the adhesive layer 228 in order to not affect the characteristics of the adhesive layer 228. A protective backing 232 can cover an exposed adhesive surface of the adhesive layer 228 to prevent premature accidental adhesion. The adhesive layer 228 is water-impermeable. When the dye-infused sticker 220 is adhered to an article by pressing the adhesive surface against it, and water is applied to the felt pad 224, the dry dye is hydrated and bleeds to areas of the article surrounding the dye-infused sticker 220. While the dye may bleed from surrounding material to underneath the dye-infused sticker 220, it is generally inhibited from bleeding directly into the region of the material to which the dye-infused sticker 220 is adhered. The adhesive layer is sufficiently weak to permit manual removal of the dye-infused sticker 220 from the article.

Figure 15:
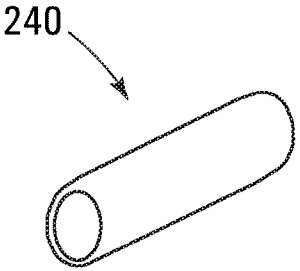
FIG. 15 shows a dye-infused roller in accordance with yet another embodiment.

FIG. 15 shows a dye applicator in accordance with a further embodiment. In this embodiment, the dye applicator is a dye-infused roller 240 that has a plastic tubular core and a foam or fiber outer surface that is impregnated with a dry dye. The dye-infused roller 240 can be rolled across a material that has been soaked to cause dye to transfer to the material. Alternatively, the dye-infused roller 240 can be soaked prior to rolling the roller across the material.

Figure 16:
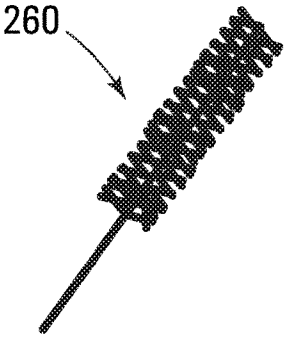
FIG. 16 shows a dye-infused fabric hair elastic in accordance with a still further embodiment.

FIG. 16 shows a dye applicator in accordance with still another embodiment. In this embodiment, the dye applicator is a dye-infused pipe cleaner 260. The dye-infused pipe cleaner 260 can be positioned in locations that are not readily accessible, such as between folds of a wet material, thereby transferring dye to the material.

In yet other embodiments, the dye applicator can be paper products

In other embodiments, the dye applicator can be non-fibrous, such as, for example, a unitary solid shape having dry dye on its surface.

The articles to which the dye may be applied via such dye applicators include fabric, carpets, wood, paper products, hair, leather, suede, or any other suitable material for receiving a fluid-borne dye without destroying the articles.

Further, while, in the above embodiment, water-soluble dyes are employed, other types of dyes such as direct and substantive dyes can be used.

The dye applicators can have a single color of dye or, alternatively, can have more than one color of dye. For example, a dye-infused string can have segments to which different colored dyes have been applied. The different colored dyes can be blended together over segments.

Figure 17:
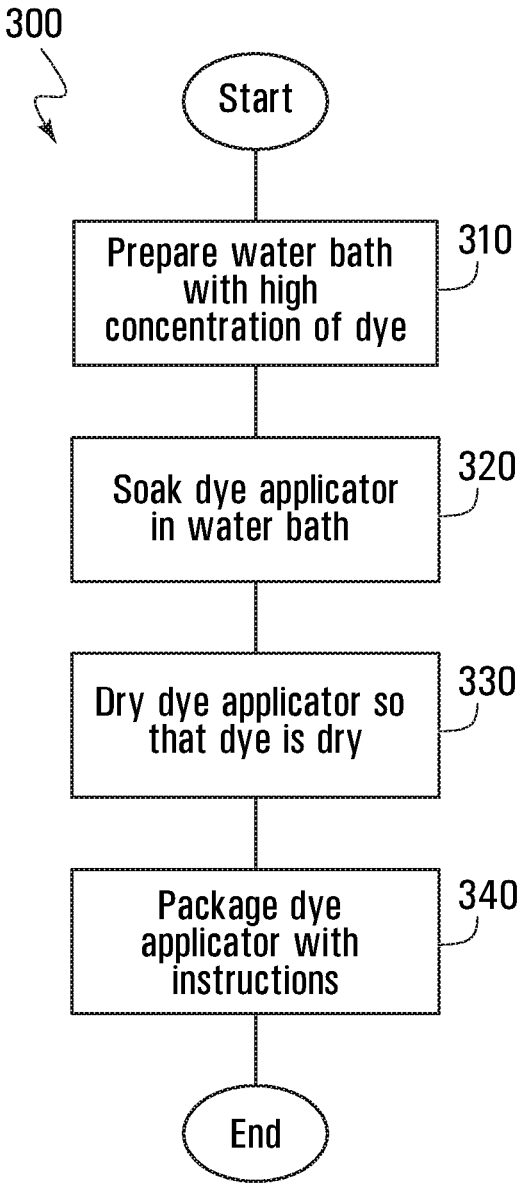
FIG. 17 shows a method for manufacturing a dye application kit in accordance with an embodiment.

FIG. 17 shows a method 300 for manufacturing a dye application kit in accordance with an embodiment. In this embodiment, the dye application kit has a dye applicator that is fibrous and impregnated with a dry water-soluble dye.

The method 300 commences with the preparation of a water bath with a high concentration of dye (310). Preferably, the concentration of dye in the water bath is higher than the desired concentration of dye to be applied to an article as the dye effectively has to be shared with the dye applicator. Once the water bath is ready, the dye applicator, or at least a portion thereof, is soaked in the water bath (320). The dye applicator can be partially or fully submersed in the water bath so that at least a portion thereof can become somewhat saturated with the dye. The dye applicator is then dried so that the dye on the dye applicator is dried (330). Drying of the dye solution on the dye applicator can be promoted by any suitable method, such as convective drying, dielectric drying, and natural air drying. The dye can coat the fibers of the dye applicator and/or can be absorbed by the fibers. Upon drying the dye on the dye applicator, the dye applicator can be packaged with instructions as to how to dye an article (340). The instructions can direct a user to place the dye applicator in close proximity to or next to the article in the presence of water. The water can be applied either before, during, or after the placement of the dye applicator proximate to or next to the article.

Other types of containers can be used to package the dye applicators, the form of which will depend upon the type of dye applicators. For example, plastic bags, cardboard boxes, metal tins, shrink wrap, or any other packaging that prevents accidental exposure of the dye applicator to liquids, or fluids in some cases.

Persons skilled in the art will appreciate that there are yet more alternative implementations and modifications possible, and that the above examples are only illustrations of one or more implementations. The scope, therefore, is only to be limited by the claims appended hereto.

The invention claimed is:

1. A dye application kit, comprising:

at least one container containing a dye applicator being at least partially fibrous and infused with a dry water-soluble dye, the dye being transferrable to an adjacent article in the presence of water, wherein the dye applicator is selected from the group consisting of a string, a hair elastic, a sticker, a roller having an at least partially fibrous cover, a pipe cleaner, and a paper product.

2. A dye application kit according to claim 1, wherein the dye applicator contained in one of the at least one container has a single dye applied thereto.

3. A dye application kit according to claim 1, wherein the dye applicator contained in one of the at least one container has at least two dyes applied thereto.

4. A dye application kit according to claim 1, wherein the dye applicator is a string, and wherein the dye application kit further comprises a drum around which an article can be secured and over which the string can be wrapped.

5. A dye application kit according to claim 4, wherein the drum is generally cylindrical.

6. A dye application kit according to claim 5, further comprising a base having at least two drum supports that support the drum proximal two opposite longitudinal ends thereof and enable the drum to rotate when supported thereon.

7. A dye application kit according to claim 6, wherein the drum has a first axle end extending from one of the two opposite ends of the drum and a second axle end extending from another of the two opposite ends of the drum, the drum supports receiving the first axle end and the second axle end to support the drum.

8. A dye application kit according to claim 7, wherein the base has a basin disposed below the drum when the base is positioned on a table surface and the drum is resting on the drum supports.

9. A dye application kit according to claim 8, further comprising at least one flexible band that can secure the article to the drum, the at least one flexible band having at least one feature to which the string can be secured.

10. A dye application kit according to claim 9, wherein each of the flexible bands includes at least one sizing peg and at least one sizing aperture for securing the flexible band to the drum about the article.

11. A dye application kit according to claim 1, wherein the dye applicator has an adhesive surface having an adhesive that adheres to the adjacent article sufficiently when exposed thereto to inhibit saturation of the dye in the article adhered to the dye applicator, the adhesive being sufficiently weak to permit manual removal of the dye applicator from the article.

12. A dye application kit according to claim 1, further comprising instructions to place the dye applicator adjacent an article to be dyed and to wet the dye applicator with water.

13. A dye applicator for dyeing materials, the dye applicator being infused with a dry water-soluble dye, the dye being transferrable to an adjacent article when water is applied, wherein the dye applicator is selected from the group consisting of a string, a hair elastic, a sticker, a roller having an at least partially fibrous cover, a pipe cleaner, and a paper product.

14. A dye applicator according to claim 13, wherein the dye applicator has an adhesive surface having an adhesive that adheres to the adjacent article sufficiently when exposed thereto to inhibit saturation of the dye in the article adhered to the dye applicator, the adhesive being sufficiently weak to permit manual removal of the dye applicator from the article.

15. A method of manufacturing a dye application kit, comprising:

exposing a dye applicator to an aqueous dye solution until the dye applicator is at least partially saturated with the aqueous dye solution, wherein the dye applicator is selected from the group consisting of a string, a hair elastic, a sticker, a roller having an at least partially fibrous cover, a pipe cleaner, and a paper product;

drying the dye applicator; and packaging the dye applicator with instructions to place the dye applicator adjacent an article to be dyed and to wet the dye applicator with water.

16. A method according to claim 15, wherein the instructions direct a user to apply water to the article to be dyed prior to placement of the dye applicator.

* * * * *